US009937605B2

(12) United States Patent
Wang

(10) Patent No.: US 9,937,605 B2
(45) Date of Patent: Apr. 10, 2018

(54) ILLUMINATION STRUCTURE FOR PLIERS

(71) Applicant: Shih Cheng Wang, Taichung (TW)

(72) Inventor: Shih Cheng Wang, Taichung (TW)

( * ) Notice: Subject to any disclaimer, the term of this patent is extended or adjusted under 35 U.S.C. 154(b) by 92 days.

(21) Appl. No.: 14/967,405

(22) Filed: Dec. 14, 2015

(65) Prior Publication Data

US 2017/0165813 A1 Jun. 15, 2017

(51) Int. Cl.

| | |
|---|---|
| ***B25B 7/22*** | (2006.01) |
| ***F21V 33/00*** | (2006.01) |
| ***F21V 23/04*** | (2006.01) |
| ***B25B 7/08*** | (2006.01) |
| ***B25B 23/18*** | (2006.01) |

(52) U.S. Cl.
CPC ..... *B25B 7/22* (2013.01); *B25B 7/08* (2013.01); *B25B 23/18* (2013.01); *F21V 23/04* (2013.01); *F21V 33/0084* (2013.01)

(58) Field of Classification Search
CPC ..... B25B 7/22
See application file for complete search history.

(56) References Cited

U.S. PATENT DOCUMENTS 2,515,292 A * 7/1950 Carr ..... B25B 7/02 362/119
2,678,919 A * 5/1954 Bartlett ..... C08F 222/14 508/468
5,921,654 A * 7/1999 Coyle ..... B25B 7/22 362/119
D563,746 S * 3/2008 Schmidt ..... D8/105
7,452,097 B1 * 11/2008 Dunbar ..... B26B 13/06 362/109
2004/0123875 A1 * 7/2004 Kim ..... A45D 29/02 132/73.5
2007/0019309 A1 * 1/2007 Neal ..... B26B 13/22 359/844
2007/0291474 A1 * 12/2007 Hui ..... A61B 17/28 362/109
2008/0309347 A1 * 12/2008 Kurtz ..... B25B 7/00 324/522
2011/0030145 A1 * 2/2011 Mandic ..... B25B 7/02 7/107

(Continued)

FOREIGN PATENT DOCUMENTS

CN WO 2012116573 A1 * 9/2012 ..... B26B 13/22

*Primary Examiner* — Charlie Y Peng

(57) ABSTRACT

An illumination structure for pliers contains: a first part, a second part, and an illumination device. The first part includes a first clamping jaw, a first handle, and a first rotatable connecting portion between the first clamping jaw and the first handle. The second part includes a second clamping jaw, a second handle, and a second rotatable connecting portion between the second clamping jaw and the second handle, wherein the first rotatable connecting portion of the first part and the second rotatable connecting portion of the second part are rotatably connected together. The first rotatable connecting portion has an accommodation groove configured to house the illumination device, and the accommodation groove has a first opening communicating with the first clamping jaw and the second clamping jaw and has a second opening communicating with the first handle. The illumination device includes a light emitting element and a control button.

3 Claims, 4 Drawing Sheets

(56) References Cited

U.S. PATENT DOCUMENTS

2015/0062876 A1* 3/2015 Brauner ..... B25B 7/06
362/119
2016/0360928 A1* 12/2016 Knittig ..... A47J 43/283

* cited by examiner

ILLUMINATION STRUCTURE FOR PLIERS

FIELD OF THE INVENTION

The present invention relates to an illumination structure for pliers in which a light emitting element is fixed between a first clamping jaw and a second clamping jaw so as to emit lights to an object directly, and the lights are not shielded by the first clamping jaw and the second clamping jaw.

BACKGROUND OF THE INVENTION

To maintain a workpiece in a dim place, a worker grasps a flashlight with one hand and holds pliers with the other hand, thus causing inconvenient maintenance.

A conventional illumination structure for pliers is disclosed in TW Patent No. M352434 and contains an accommodation groove defined on a protective sleeve of a handle so as to connect with a casing. The casing is configured to house a light emitting element for emitting lights from two clamping jaws, and the casing has at least one battery housed therein and has a control button fixed thereon, such that the control button controls the light emitting element to electrically connect with the at least one battery, thus illuming the lights to the workpiece from the two clamping jaws.

However, the light emitting element is mounted on the two clamping jaws so after the two clamping jaws expand outwardly, they shield the lights.

The present invention has arisen to mitigate and/or obviate the afore-described disadvantages.

SUMMARY OF THE INVENTION

The primary objective of the present invention is to provide an illumination structure for pliers in which a light emitting element is fixed between a first clamping jaw and a second clamping jaw so as to emit lights to an object directly, and the lights are not shielded by the first clamping jaw and the second clamping jaw.

To obtain the above objective, an illumination structure for pliers provided by the present invention contains: a first part, a second part, and an illumination device.

The first part includes a first clamping jaw, a first handle, and a first rotatable connecting portion defined between the first clamping jaw and the first handle.

The second part includes a second clamping jaw, a second handle, and a second rotatable connecting portion defined between the second clamping jaw and the second handle, wherein the first rotatable connecting portion of the first part and the second rotatable connecting portion of the second part are rotatably connected together.

The first rotatable connecting portion of the first part has an accommodation groove defined thereon so as to house the illumination device, and the accommodation groove has a first opening which communicates with the first clamping jaw and the second clamping jaw, the accommodation groove further has a second opening which is located proximate to and is in communication with the first handle, wherein the illumination device includes a light emitting element corresponding to the first opening and includes a control button corresponding to the second opening.

DETAILED DESCRIPTION OF THE PREFERRED EMBODIMENTS

Figure 1:
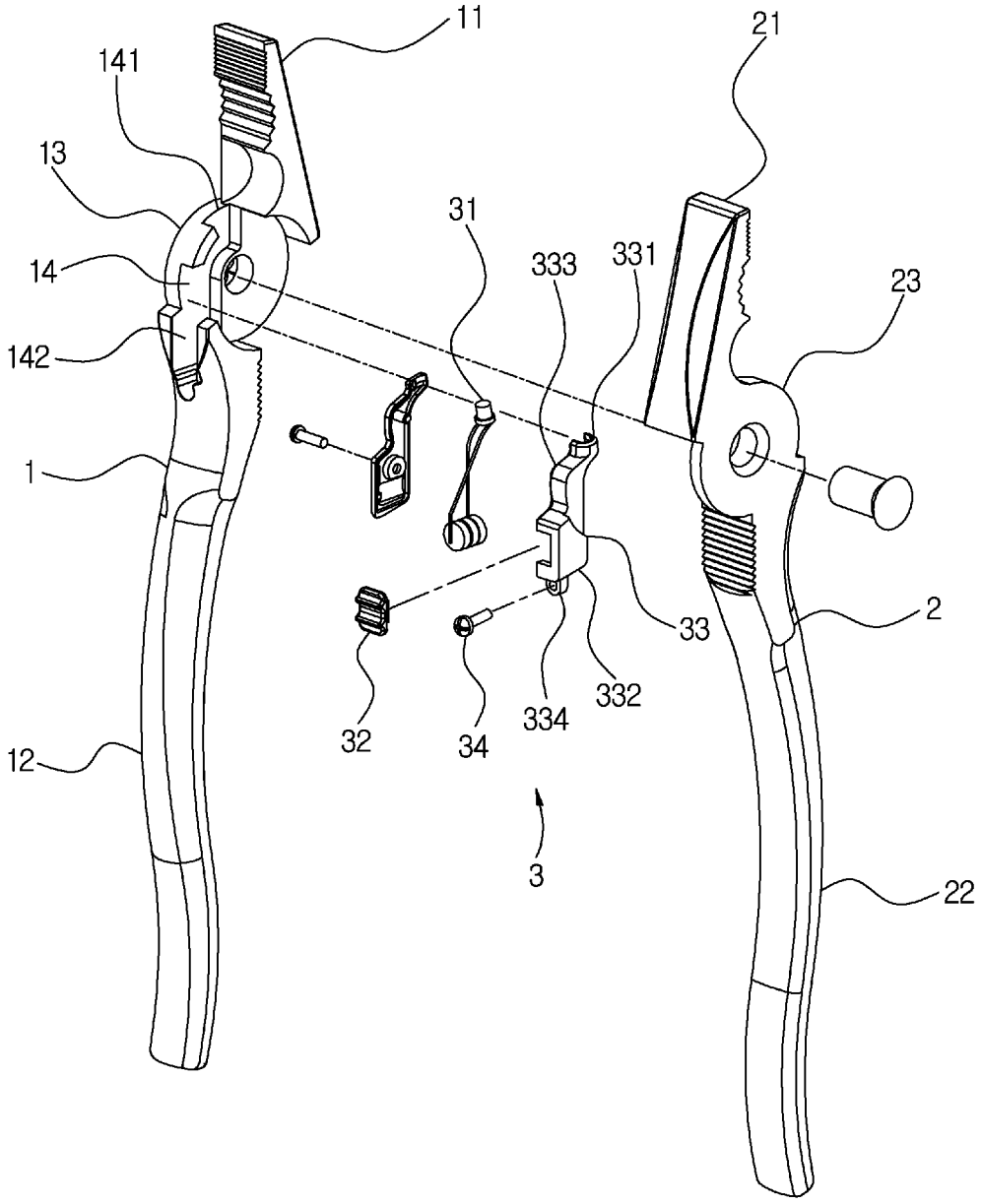
FIG. 1 is a perspective view showing the exploded components of an illumination structure for pliers according to a preferred embodiment of the present invention.
Figure 2:
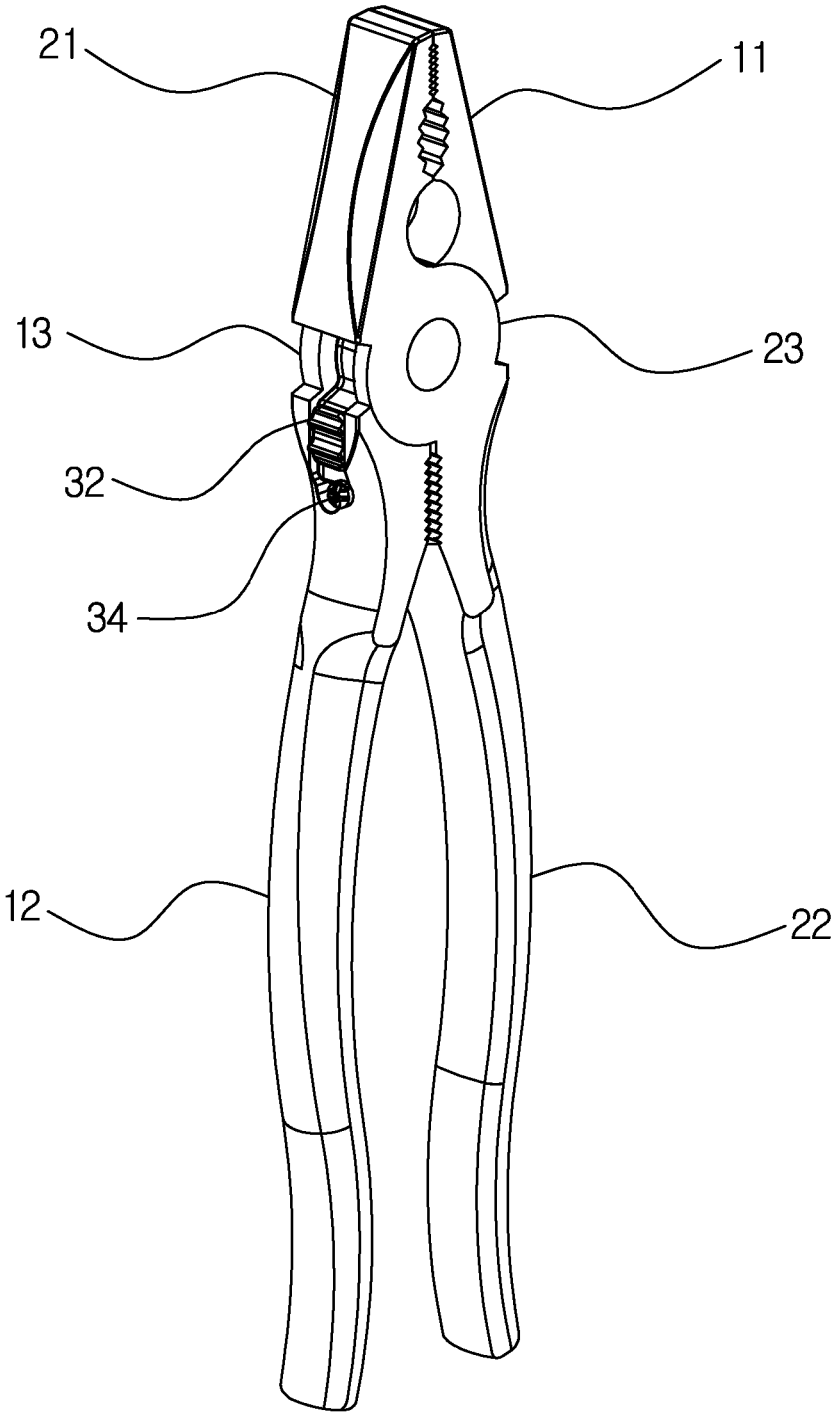
FIG. 2 is a perspective view showing the assembly of the illumination structure for the pliers according to the preferred embodiment of the present invention.
Figure 3:
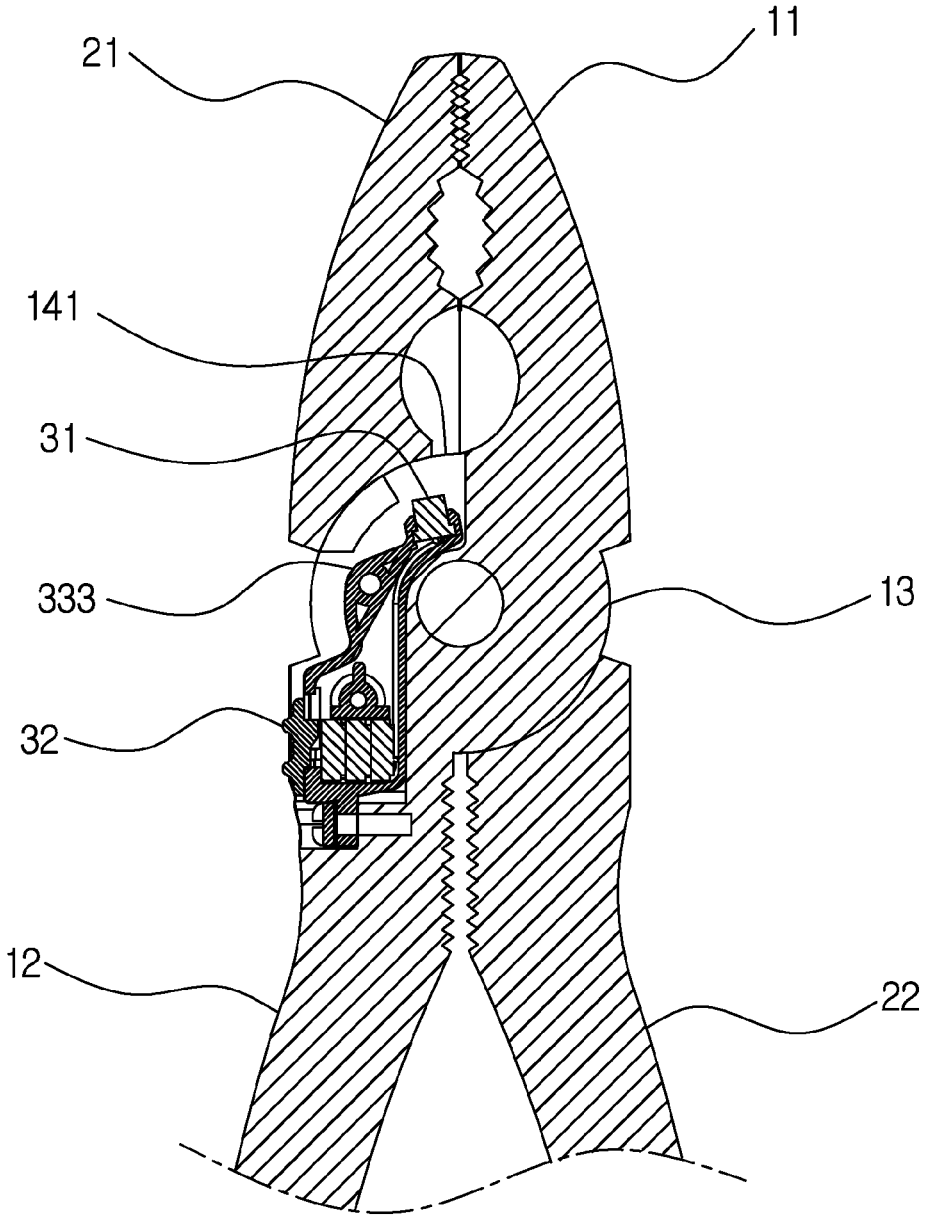
FIG. 3 is a cross sectional view showing the assembly of a part of the illumination structure for the pliers according to the preferred embodiment of the present invention.

With reference to FIGS. 1 to 4, an illumination structure for pliers according to a preferred embodiment of the present invention is mounted on a connection area of a first part and a second part of the pliers so as to emit lights to an object from a first clamping jaw and a second clamping jaw. The illumination structure for the pliers comprises: the first part 1, the second part 2, and an illumination device 3.

The first part 1 includes the first clamping jaw 11, a first handle 12, and a first rotatable connecting portion 13 defined between the first clamping jaw 11 and the first handle 12. The second part 2 includes the second clamping jaw 21, a second handle 22, and a second rotatable connecting portion 23 defined between the second clamping jaw 21 and the second handle 22, wherein the first rotatable connecting portion 13 of the first part 1 and the second rotatable connecting portion 23 of the second part 2 are rotatably connected together. The first rotatable connecting portion 13 of the first part 1 has an accommodation groove 14 defined thereon so as to house the illumination device 3, and the accommodation groove 14 has a first opening 141 which communicates with the first clamping jaw 11 and the second clamping jaw 21, the accommodation groove 14 further has a second opening 142 which is located proximate to and is in communication with the first handle 12, wherein the illumination device 3 includes a light emitting element 31 corresponding to the first opening 141 and includes a control button 32 corresponding to the second opening 142.

Figure 4:
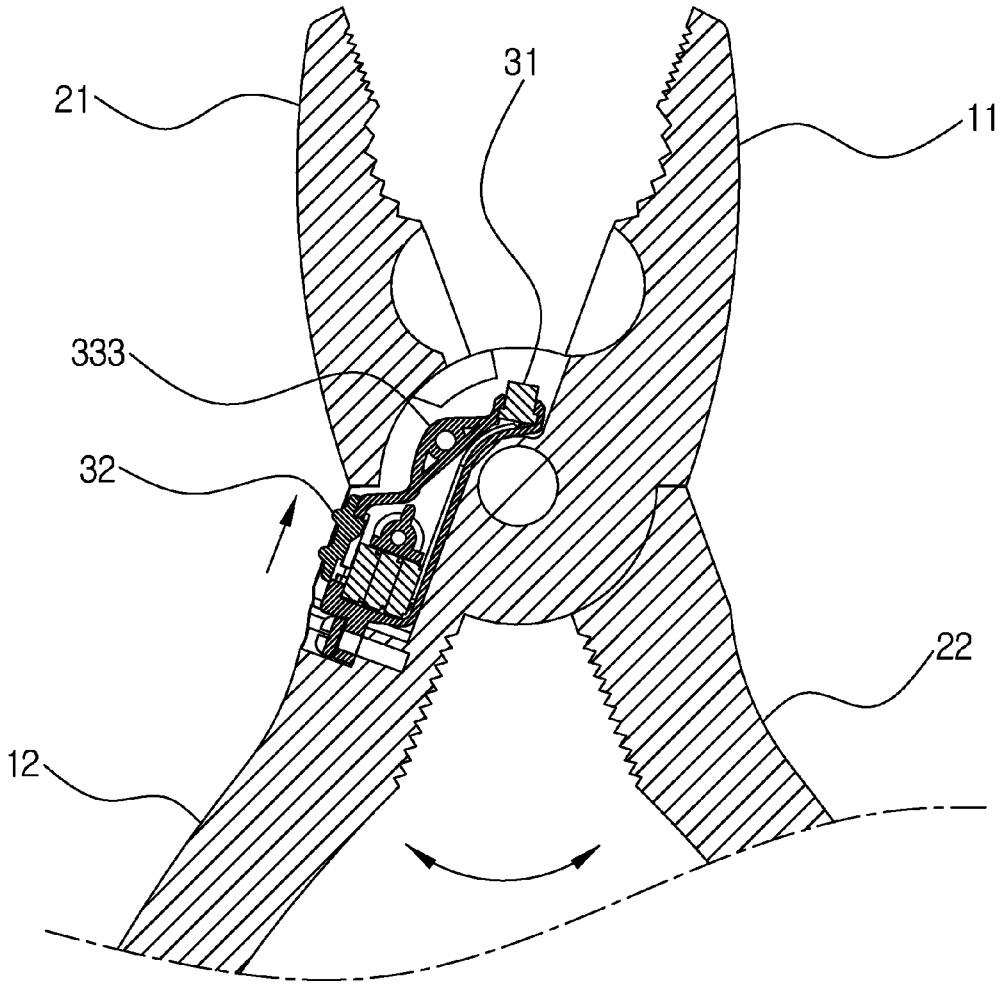
FIG. 4 is a cross sectional view showing the operation of a part of the illumination structure for the pliers according to the preferred embodiment of the present invention.

Thereby, the light emitting element 31 is fixed between the first clamping jaw 11 and the second clamping jaw 21 so as to emit the lights to the object directly, and the lights are not shielded by the first clamping jaw 11 and the second clamping jaw 21, as shown in FIG. 4.

The illumination device 3 also includes a coupling seat 33 fixed in the accommodation groove 14, and the coupling seat 33 has a first end portion 331 configured to extend the light emitting element 31 outwardly, and the coupling seat 33 also has a second end portion 332 on which the control button 32 slides, wherein between the first end portion 331 and the second end portion 332 of the coupling seat 33 is defined an arcuate section 333, and an area of the coupling seat 33 decreases from the second end portion 332 to the first end portion 331. A power supply system to the illumination device 3 is a well-known art, so further remarks are omitted. Preferably, related components of the illumination device 3 are connected together easily by way of the coupling seat 33, the coupling seat 33 is replaced quickly from the second opening 142, and the arcuate section 333 does not contact with a connection bolt of the first part 1 and the second part 2.

The coupling seat 33 further has a locking orifice 334 formed on the second end portion 332, and the illumination device 3 includes a fixing column 34 configured to lock the coupling seat 33 with the first part 1 through the locking orifice 334, such that the coupling seat 33 is connected with the first part 1 firmly by using the fixing column 34.

While the preferred embodiments of the invention have been set fourth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. An illumination structure for pliers comprising:

a first part, a second part, and an illumination device; wherein the first part includes a first clamping jaw, a first handle, and a first rotatable connecting portion defined between the first clamping jaw and the first handle;

the second part includes a second clamping jaw, a second handle, and a second rotatable connecting portion defined between the second clamping jaw and the second handle, wherein the first rotatable connecting portion of the first part and the second rotatable connecting portion of the second part are rotatably connected together;

the first rotatable connecting portion of the first part has an accommodation groove defined thereon so as to house the illumination device, first and second openings disposed on opposite ends of the accommodation groove, the first opening communicating with and facing the first clamping jaw and the second clamping jaw, the second opening located proximate to and in communication with the first handle, wherein the illumination device includes a light emitting element illuminating from the first opening and includes a control button accessible in the second opening; and the illumination device is sandwiched in the accommodation groove between the first part and the second part.

2. The illumination structure for the pliers as claimed in claim 1, wherein the illumination device also includes a coupling seat fixed in the accommodation groove, and the coupling seat has a first end portion configured to extend the light emitting element outwardly, and the coupling seat also has a second end portion on which the control button slides, wherein between the first end portion and the second end portion of the coupling seat is defined an arcuate section, and an area of the coupling seat decreases from the second end portion to the first end portion.

3. The illumination structure for the pliers as claimed in claim 2, wherein the coupling seat further has a locking orifice formed on the second end portion, and the illumination device includes a fixing column configured to lock the coupling seat with the first part through the locking orifice.

* * * * *